United States Patent [19]

Norton et al.

[11] 4,288,929

[45] Sep. 15, 1981

[54] MOTION CONTROL DEVICE FOR ATHLETIC SHOE

[75] Inventors: Edward J. Norton, Kingston, N.H.; Kenneth W. Graham, Melrose, Mass.

[73] Assignee: New Balance Athletic Shoe, Inc., Lawrence, Mass.

[21] Appl. No.: 112,207

[22] Filed: Jan. 15, 1980

[51] Int. Cl.[3] ..... A43B 23/08
[52] U.S. Cl. ..... 36/69
[58] Field of Search ..... 36/68, 69, 71

[56] References Cited

U.S. PATENT DOCUMENTS

| | | | |
|---|---|---|---|
| 1,887,935 | 11/1932 | Lake | 36/68 |
| 3,333,353 | 8/1967 | Garcia | 36/69 |
| 3,500,561 | 3/1970 | Epstein | 36/69 |

*Primary Examiner*—Patrick D. Lawson
*Attorney, Agent, or Firm*—Pennie & Edmonds

[57] ABSTRACT

A control device for footwear, such as an athletic shoe, including a body having a base with relatively flat upper and lower surfaces and a wall extending upwardly around a heel portion to extend along both a medial and lateral portion to an end. The body is formed of plastic to be yieldable, but relatively sturdy for support of the foot in a neutral plane and control roll of the foot during a running cycle.

16 Claims, 7 Drawing Figures

MOTION CONTROL DEVICE FOR ATHLETIC SHOE

TECHNICAL FIELD

The present invention is in a control device for use with footwear, such as athletic shoes, and particularly athletic shoes for runners, joggers and the like, for the support of the foot and control of pronation in the running cycle.

BACKGROUND ART

Athletic shoes generally are fabricated from soft, pliable, light-weight materials, such as nylon, to enable the individual to exercise without unnecessarily adding to the stress of the exercise through heavier, more rigid shoes. However, it is during this type of activity, such as running, jogging and the like, that the individual may require support at the joints.

The recognized cycle of foot movement during running, jogging and the like typically is found to be heel strike, ball strike, pronation, release and supination. It has been found that the nylon-type athletic shoe fails to provide the support necessary for the foot during activity of this type. Thus, the known athletic shoe fails in the support of the foot securely in a neutral plane and allows the foot, because of the natural flexibility of the material to roll or pronate excessively during the cycle of movement. Running related injuries, not only to the ankle, but quite often to the knee and hip, may occur.

The control device of the present invention functions to control pronation and thereby eliminate or at least reduce the incidents of running related injury. The control device, even when used with the typical flexible athletic shoe, secures the runner's foot in a neutral plane thereby to reduce the amount of pronation which may be referred to as roll of the foot and, thus, overcomes the problems and disadvantages found to exist in prior art athletic shoes.

DISCLOSURE OF THE INVENTION

The present invention is directed to a control device for use in footwear, such as an athletic shoe, and to the footwear including a sole and lasted upper with which the control device is used to support the foot in a neutral plane and control the roll of the foot during a running cycle. It is the function of the control device to prevent or substantially reduce the occurrence of running related injury. The control device includes a body having a base with relatively flat upper and lower surfaces, and a wall extending upwardly from the upper surface around the heel and along both a medial and lateral side of the body. The body is formed of a material which is sturdy, yet has a degree of flexibility; and the wall is of a height to confine the heel of the foot, and, additionally, it is substantially vertical along the medial extent. It is the medial wall that enhances the function of the control device to a major extent.

BEST MODE FOR CARRYING OUT THE INVENTION

The control device 10, illustrated in FIGS. 3–6, comprises the right control device of a pair of complementary left and right control devices suitably adapted for use with left and right athletic shoes, respectively.

Figure 1:
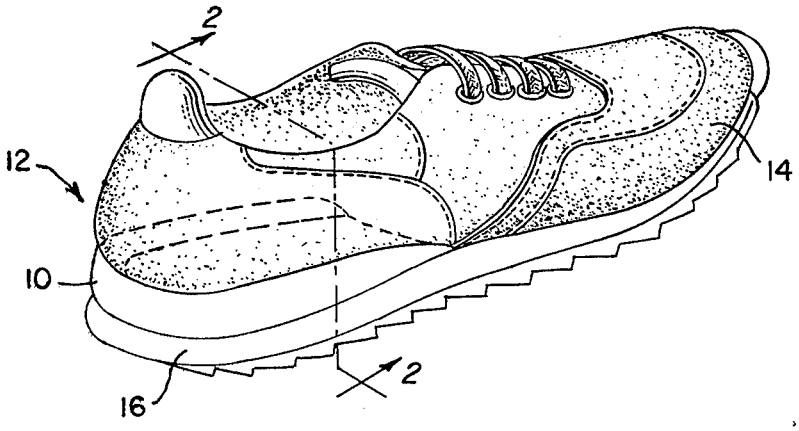
FIG. 1 is a perspective view of an athletic shoe illustrating the positional location of the control device of the present invention.
Figure 2:
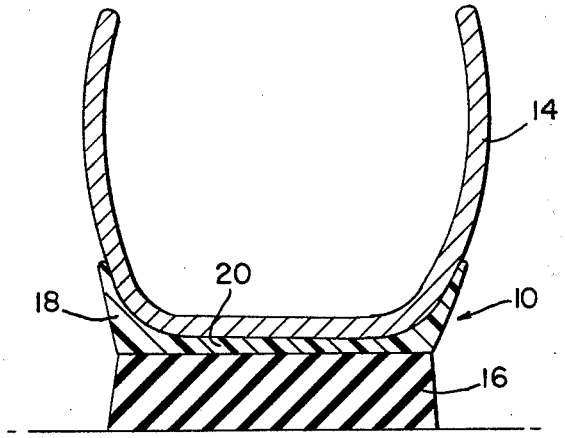
FIG. 2 is a view in section as seen along the line 2—2 in FIG. 1.

Such an athletic shoe 12 which may be considered as being of a construction well known in the art, and typically one used by runners, joggers and the like, may comprise a lasted upper 14, providing a foot receiving opening and securing laces, and a sole 16. As illustrated in both FIGS. 1 and 2, the athletic shoe is of the low-cut variety and the sole is provided with a pattern of alternately high and low ridges of generally sinuous outline extending thereacross from the medial to the lateral side. Other patterned surfaces, provided for gripping, as is well known, may be provided.

Referring again to FIGS. 1 and 2, it will be seen that the control device 10 is located with its relatively flat undersurface in juxtaposition to the upper surface of the sole with the result that the upper surface of the control device, then, serves as a support for the lasted upper. The control device is of a length and width, as determined by the particular size of the athletic shoe with which it is used, to extend from the rear of the heel region of the sole forwardly torward the toe, and from the medial to the lateral side of the sole. As may be seen in FIG. 1, the control device extends generally to the location of the instep of the foot to which the athletic shoe is accommodated.

Without any intent to limit the invention, but rather to more specifically describe a control device which has been found to provide desired results in the control of pronation, the control device may be formed of a plastic, such as polyethylene, which may be cross-linked and designed to be flame treated, and polyurethane; and further, the control device may provide for a thickness of wall 18 in the range of about 1.4 to 1.6 mm with a thickness of base 20 in the range of about 2.3 to 2.5 mm. Preferably, the control device is formed of polyurethane, which provides necessary sturdiness and in a preferred embodiment the thickness of the wall is 1.5 mm and the thickness of the base is 2.4 mm. This material may have a hardness, measured by the Shore A Durometer in a range of about 65 to 85.

The control device 10 may be molded according to wellknown molding techniques, is secured to the sole 16 and the lasted upper 14, in turn, is secured to the control device. Any type or form of an adhesive, or epoxy resin, or the equivalent which typically finds use in the footwear industry may be used to secure the structures.

Figure 7:
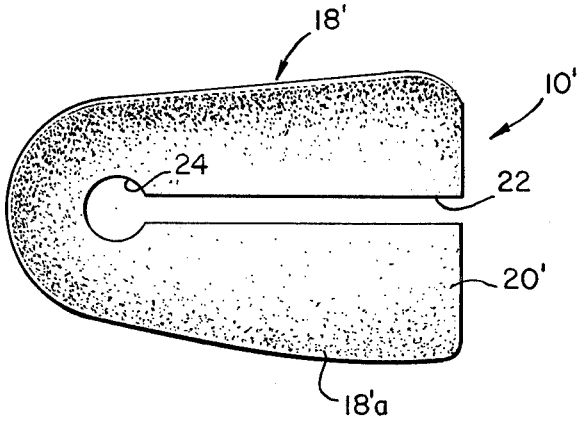
FIG. 7 is a plan view of a second form of control device, the size being reduced somewhat from the size of the control device of FIG. 3, which may be located in the athletic shoe in the region illustrated in FIG. 1.

Referring to FIG. 7, there is illustrated a second form of control device 10' formed of the material and having the characteristic thickness of wall 18' and base 20', as previously discussed. The control device 10', however, includes a slot 22 which extends rearwardly of the end at the instep terminating at a circular cutout 24 within the region of the ball of the heel. The slot and cutout, of a dimension which would retain a significant major portion of the base 20', introduce a degree of further flexibility or yieldability to the control device 10' without loss in the control of pronation and, additionally, the slot and cutout permit the realization of a savings of material with an attendant cutting of cost. In both forms of the invention, the control device may be somewhat tapered or feathered across the end from the medial to the lateral wall within the region of the instep of the foot. This will eliminate or substantially reduce possible discomfort to the foot because of an abrupt termination of the base.

Figure 3:
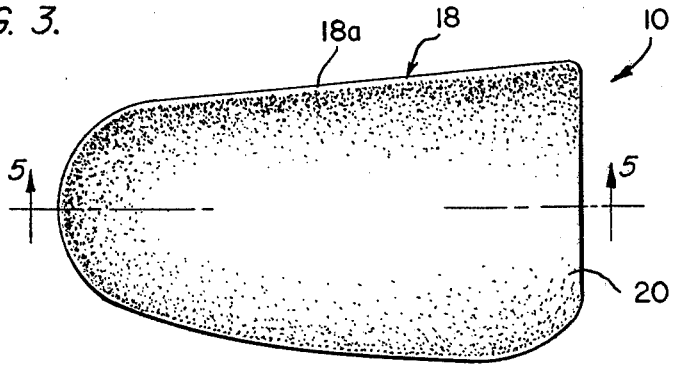
FIG. 3 is a plan view of the control device.
Figure 4:
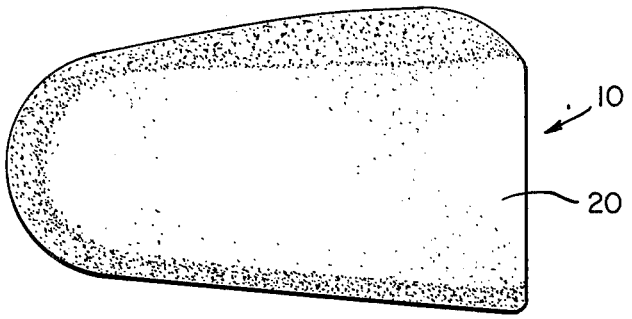
FIG. 4 is a bottom view of the control device.
Figure 5:
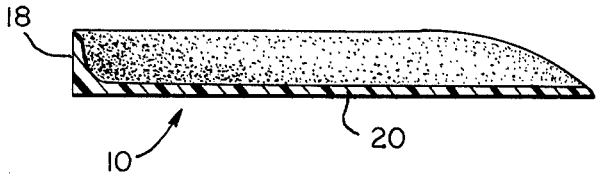
FIG. 5 is a view in section as seen along the line 5—5 in FIG. 3.
Figure 6:
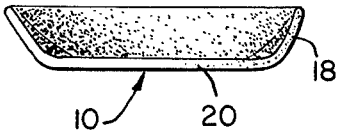
FIG. 6 is a view in elevation looking toward the portion adjacent the rear heel of the control device.

Referring to FIGS. 3 and 7, representing, respectively, a right and left control device, it will be seen that the medial wall 18*a* (and 18*a'*) extends in a somewhat more vertical direction from the base 20 (and 20') than the lateral wall.

This orientation of the medial wall, contrasted to the greater slope of the lateral wall of each control device, introduces more rigidity in the successful functioning of the control device. Again, without the intent to limit the invention, but rather to describe a control device which has been successfully used, the height of the wall 18 (and 18') may be about 21 mm, measured from the flat undersurface.

In use, it is the function of the control device 10 (or 10') to control pronation. Most runners, joggers and the like follow a cycle of foot movement which may be characterized as heel strike, ball strike, pronation, release and supination. As used herein, the term "pronation" defines a foot roll to the medial or inside of the foot, and "supination" may be considered the rotation of a joint (hip, knee, ankle, and so forth) backward and away from the midline of the body. The control device situated as hereinbefore described provides a mechanical control to hold the runner's foot securely in a neutral plane, i.e., the natural position of the foot while in motion in a normal gait cycle, thereby to reduce the amount of roll of the foot which otherwise may result in, or be the cause of, running related injury to the foot, ankle, knee, and so forth. Further, the control device serves the function of reducing stress which runners may experience during the period of activity. The control device, also, permits the use of a more flexible training shoe, a shoe which otherwise may encourage, for example, abnormal range of motion or erratic gait.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

We claim:

1. For use in footwear, a control device adapted to reside in a disposition above the sole of the footwear at least in the region of the heel and provide support for the lasted upper of the footwear, said control device including a body having a base with relatively flat upper and lower surfaces, and a wall extending upwardly from the upper surface around the heel and along both a medial and lateral side of the body, said wall throughout its length being of a height to confine the heel and along the medial side and around the heel the wall extends substantially vertically from the upper surface, and said lateral side has greater slope, said body being formed of a yieldable, but relatively sturdy material for support of the foot in a neutral plane, and said medial wall introducing a degree of rigidity in the maintenance of a normal range of motion of the foot during a running cycle.

2. The control device of claim 1 wherein the body is formed of polyurethane and it extends forwardly of the heel to an end in the region of the instep of the foot.

3. The control device of claim 2 wherein the upper surface at the end is tapered toward the bottom surface.

4. The control device of claim 1 wherein the base has a thickness of about 2.3 to 2.5 mm and the wall has a thickness of about 1.4 to 1.6 mm.

5. The control device of claim 4 wherein the thickness of the base is 2.4 mm and the thickness of the wall is 15 mm.

6. The control device of claim 2 further including a slot and a cutout, said slot extending from the end of the base toward the heel and terminating in said cutout, said cutout being located equidistantly from the wall both around the heel and along the medial and lateral sides of the body, and said slot being disposed along the longitudinal axis of the body, said slot and cut-out adding a degree of flexibility to said body.

7. The control device of claim 2 wherein the hardness of said body is in the range of about 65 to 85 Shore A Durometer.

8. Footwear including a sole, a lasted upper and a control device adapted to be received on said sole within a region extending from the heel portion of the sole forwardly toward the toe portion, said control device including a body having a base with relatively flat upper and lower surfaces, said lower surface being mounted on said base, and a wall extending upwardly from the upper surface around the heel and along both a medial and lateral side of the body, said wall throughout its length being of a height to confine the heel and along the medial side and around the heel extending substantially vertically from the upper surface, said lasted upper being mounted on said control device for support by said wall and upper surface, said body being formed of a yieldable, but relatively sturdy material for support of the foot in a neutral plane, and said medial wall introducing a degree of rigidity in the maintenance of a normal range of motion of the foot during a running cycle.

9. The footwear of claim 8 wherein the body is formed of polyurethane and extends forwardly of the heel to an end in the region of the instep of the foot.

10. The footwear of claim 9 wherein the upper surface at the end is tapered toward the bottom surface.

11. The footwear of claim 8 wherein the base has a thickness of about 2.3 to 2.5 mm and the wall has a thickness of about 1.4 to 1.6 mm.

12. The footwear of claim 11 wherein the thickness of the base is 2.4 mm and the thickness of the wall is 1.5 mm.

13. The footwear of claim 9 further including a slot and cutout, said slot extending from the end of the base toward the heel and terminating in said cut-out, said cut-out being located equidistantly from the wall both around the heel and along the medial and lateral sides of the body, and said slot being disposed along the longitudinal axis of the body, said slot and cut-out adding a degree of flexibility to said body.

14. The footwear of claim 9 wherein the hardness of said body is in the range of about 65 to 85 Shore A Durometer.

15. The control device of claim 5 wherein the height of said wall measured from said flat lower surface is about 21 mm.

16. The footwear of claim 12 wherein the height of said wall measured from said flat lower surface is about 21 mm.

* * * * *

REEXAMINATION CERTIFICATE (468th)

United States Patent [19] [11] B1 4,288,929

Norton et al. [45] Certificate Issued Feb. 18, 1986

[54] MOTION CONTROL DEVICE FOR ATHLETIC SHOE

[75] Inventors: Edward J. Norton, Kingston, N.H.; Kenneth W. Graham, Melrose, Mass.

[73] Assignee: New Balance Athletic Shoe, Inc., Lawrence, Mass.

Reexamination Request:
No. 90/000,781, May 14, 1985

Reexamination Certificate for:

| | |
|---|---|
| Patent No.: | **4,288,929** |
| Issued: | **Sep. 15, 1981** |
| Appl. No.: | **112,207** |
| Filed: | **Jan. 15, 1980** |

[51] Int. Cl.[4] ..... A43B 23/08; A43B 5/00
[52] U.S. Cl. ..... 36/69; 36/129
[58] Field of Search ..... 36/68, 69, 71, 72 B, 36/92, 114, 128, 129, 80

[56] References Cited

U.S. PATENT DOCUMENTS

| | | |
|---|---|---|
| Re. 27,512 | 10/1972 | Onitsuka . |
| 1,720,120 | 7/1929 | Diveley et al. . |
| 2,635,362 | 4/1953 | Lelyveld . |
| 3,309,797 | 3/1967 | Poitras . |
| 3,593,437 | 7/1971 | Kogert . |
| 3,810,318 | 5/1974 | Epstein . |
| 4,255,877 | 3/1981 | Bowerman . |

FOREIGN PATENT DOCUMENTS

| | | | |
|---|---|---|---|
| 1109282 | 9/1955 | France | 36/68 |
| 742981 | 1/1956 | United Kingdom . | |
| 1015990 | 1/1966 | United Kingdom . | |
| 1316374 | 5/1973 | United Kingdom . | |

*Primary Examiner*—James Kee Chi

[57] ABSTRACT

A control device for footwear, such as an athletic shoe, including a body having a base with relatively flat upper and lower surfaces and a wall extending upwardly around a heel portion to extend along both a medial and lateral portion to an end. The body is formed of plastic to be yieldable, but relatively sturdy for support of the foot in a neutral plane and control roll of the foot during a running cycle.

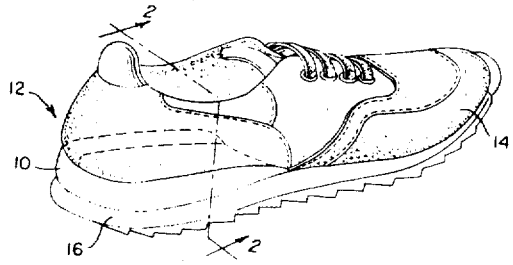

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 55–60:

The control device 10 may be molded according to [wellknown] *well known* molding techniques[, is] *and* secured to sole 16. [and the] *The* lasted upper 14, in turn, is secured to the control device. Any type or form of an adhesive, or epoxy resin, or the equivalent which typically finds use in the footwear industry may be used to secure the structures.

AS A RESULT OF REEXAMINATION, IT HAS BEEN DETERMINED THAT:

Claims 1–3, 5, 6, 8–10 and 13 are determined to be patentable as amended.

Claims 4, 7, 11, 12 and 14–16, dependent on an amended claim, are determined to be patentable.

1. For use in footwear, a control device adapted to reside [in a disposition above the] *juxtaposed an upper surface of a* sole of the footwear [at least in] *within* the region of the heel and *along the sole forwardly toward the region of the toes, said control device extending to the region of but not beyond the location of the instep of the foot to* provide support for [the lasted] *an* upper of the footwear *and the foot of the wearer to support the foot in a neutral plane and control pronation of the foot in a running cycle,* said control device including a body having a base with relatively flat upper and lower surfaces, and a wall extending upwardly from the upper surface around the heel and along both a medial and lateral side of the body, said wall throughout its length being of a height to confine the heel and along the medial side and around the heel the wall extends substantially vertically from the upper surface, and said lateral side has greater slope, said body being formed of a yieldable, but relatively sturdy material for support of the foot in [a] *said* neutral plane, and said medial wall introducing a degree of rigidity in the maintenance of a normal range of motion of the foot during [a] said running cycle.

2. The control device of claim 1 wherein the body is formed of polyurethane [and it extends forwardly of the heel to an end in the region of the instep of the foot].

3. The control device of claim [2] *1* wherein the upper surface at the end is tapered toward the bottom surface.

5. The control device of claim 4 wherein the thickness of a base is 2.4 mm and the thickness of the wall is [15] *1.5* mm.

6. The control device of claim [2] *1* further including a slot and a cutout, said slot extending from the end of the base toward the heel and terminating in said cutout, said cutout being located equidistantly from the wall both around the heel and along the medial and lateral sides of the body, and said slot being disposed along the longitudinal axis of the body, said slot and [cut-out] *cutout* adding a degree of flexibility to said body.

8. Footwear including a sole, [a lasted] *an* upper and a control device adapted to be received on said sole *juxtaposed an upper surface* within a region *of the heel portion and* extending from the heel portion of the sole forwardly toward the toe portion, *said control device extending to the region of but not beyond the location of the instep of the foot to provide support for the foot of the wearer in a neutral plane and control pronation of the foot in a running cycle,* said control device including a body having a base with relatively flat upper and lower surfaces, said lower surface being mounted on said base, and a wall extending upwardly from the upper surface around the heel and along both a medial and lateral side of the body, said wall throughout its length being of a height to confine the heel and along the medial side and around the heel extending substantially vertically from the upper surface, said [lasted] upper being mounted on said control device for support by said wall and upper surface, said body being formed of a yieldable, but relatively sturdy material for support of the foot in [a] *said* neutral plane, and said medial wall introducing a degree of rigidity in the maintenance of a normal range of motion of the foot during [a] *said* running cycle.

9. The footwear of claim 8 wherein the body is formed of a polyurethane [and extends forwardly of the heel to an end in the region of the instep of the foot].

10. The footwear of claim [9] *8* wherein the upper surface at the end is tapered toward the bottom surface.

13. The footwear of claim [9] *8* further including a slot and cutout, said slot extending from the end of the base toward the heel and terminating in said [cut-out] *cutout*, said [cut-out] *cutout* being located equidistantly from the wall both around the heel and along the medial and lateral sides of the body, and said slot being disposed along the longitudinal axis of the body, said slot and [cut-out] *cutout* adding a degree of flexibility to said body.

* * * * *